US006378750B1

(12) United States Patent
Disano et al.

(10) Patent No.: US 6,378,750 B1
(45) Date of Patent: Apr. 30, 2002

(54) METHOD AND APPARATUS FOR APPLYING STRIPES TO A MOVING WEB

(75) Inventors: John Nicholas Disano, Ottawa; Alan Short, Milton, both of (CA)

(73) Assignee: Agra Vadeko Inc., Ontario (CA)

( * ) Notice: Subject to any disclaimer, the term of this patent is extended or adjusted under 35 U.S.C. 154(b) by 0 days.

(21) Appl. No.: 09/396,392

(22) Filed: Sep. 15, 1999

(30) Foreign Application Priority Data

Sep. 16, 1998 (GB) ..... 9820138

(51) Int. Cl.[7] ..... B65H 20/24
(52) U.S. Cl. ..... 226/113; 156/233; 156/238
(58) Field of Search ..... 226/113, 155; 156/552, 540–541, 542, 233, 238, 240; 101/6, 23, 33, 34

(56) References Cited

U.S. PATENT DOCUMENTS

| | | | | | |
|---|---|---|---|---|---|
| 811,270 | A | * | 1/1906 | Bechman | 226/113 |
| 2,714,268 | A | * | 8/1955 | Battey | 226/113 |
| 3,815,494 | A | | 6/1974 | Bahnmüller | |
| 4,236,955 | A | * | 12/1980 | Prittie | 156/353 |
| 4,379,017 | A | * | 4/1983 | Barta | 156/238 |
| 4,886,199 | A | * | 12/1989 | Noe et al. | 226/113 X |
| 5,328,546 | A | * | 7/1994 | Brady et al. | 156/542 X |
| 5,483,893 | A | | 1/1996 | Isaac et al. | |
| 5,520,763 | A | * | 5/1996 | Johnstone | 156/233 |
| 5,693,165 | A | * | 12/1997 | Schmitz | 156/164 |

FOREIGN PATENT DOCUMENTS

| | | |
|---|---|---|
| DE | 0241212 | 11/1911 |
| FR | 2171710 | 9/1973 |
| GB | 1058883 | 2/1967 |
| GB | 2 034 247 | 6/1980 |
| GB | 1 600 058 | 10/1981 |
| GB | 2 145 068 | 3/1985 |
| GB | 2 194 517 | 3/1988 |
| GB | 2 198 265 | 6/1988 |
| WO | WO 98/12051 | 3/1998 |

* cited by examiner

*Primary Examiner*—Michael R. Mansen
(74) *Attorney, Agent, or Firm*—Connolly Bove Lodge & Hutz LLP

(57) ABSTRACT

An apparatus for applying stripes on a carrier to a moving web includes a first drive to advance the carrier continuously from an unwind reel to a take-up reel at a generally constant speed. A nip is intermediate the unwind reel and the take-up reel through which the carrier and the web pass. The nip applies the stripes to the web. A reciprocating shuttle is moveable back and forth along a generally linear path. The shuttle includes a first set of spaced rollers thereon adjacent one end thereof and a second set of spaced rollers thereon adjacent an opposite end thereof. A first stationary set of spaced rollers is associated with the first set of rollers. The first stationary set of spaced rollers is positioned adjacent one end of the path and intermediate the unwind reel and the nip. A second stationary set of spaced rollers is associated with the second set of rollers. The second stationary set of spaced rollers is positioned adjacent an opposite end of the path and intermediate the nip and the take-up reel. The carrier alternately winds around the rollers of the first set of spaced rollers and the first stationary set of spaced rollers as the carrier travels from the unwind reel to the nip. The carrier also alternately winds around the rollers of the second set of spaced rollers and the second stationary set of spaced rollers as the carrier travels from the nip to the take-up reel. A second drive reciprocates the shuttle along the linear path. The shuttle is driven in a manner so that the carrier intermittently moves through the nip even though the carrier is advanced continuously by the first drive.

16 Claims, 5 Drawing Sheets

METHOD AND APPARATUS FOR APPLYING STRIPES TO A MOVING WEB

FIELD OF THE INVENTION

The present invention relates to a method and apparatus for applying stripes to a moving web. More specifically, the present invention relates to a method and apparatus for registering and applying stripes to individual banknotes of banknote sheets.

BACKGROUND OF THE INVENTION

To deter counterfeiting, credit cards, smart cards, passports, banknotes and other valuable paper documents typically incorporate a variety of security features. One known type of security feature is in the form of a thin film structure comprising a foil substrate and a multi-layer interference coating carried by the substrate. The multi-layer interference coating produces an inherent color shift with a change in viewing angle. This type of security feature has been used on Canadian banknotes. It is of course desired to apply these security features to banknotes quickly, easily and in a cost effective manner without disrupting the banknote printing process.

It is therefore an object of the present invention to provide a novel method and apparatus for applying a stripe disposed on a carrier onto a moving web.

SUMMARY OF THE INVENTION

According to one aspect of the present invention there is provided an apparatus for applying a stripe disposed on a carrier onto a moving web comprising:

- a drive to advance said carrier from an unwind reel to a take-up reel;
- a nip intermediate said unwind reel and said take-up reel through which said carrier and said web pass to apply said stripe to said web; and
- a modulator acting on said carrier to modulate the speed of said carrier passing through said nip so that the speed of said carrier passing through said nip coincides generally with the speed of the web passing through said nip without changing the speed at which said carrier is advanced by said drive.

In a preferred embodiment, the web is discontinuous defining successive sheets and wherein the carrier is in the form of a ribbon. The modulator modulates the speed of the ribbon so that it is generally stationary at the nip when gaps between successive sheets occur at the nip. In one form, the modulator includes a reciprocating or oscillating shuttle carrying a roller set adjacent each end thereof and a stationary roller set associated with and in line with each roller set carried by the shuttle. The ribbon is alternately wound around the rollers of one roller set on the shuttle and the rollers of the associated stationary roller set prior to passing through the nip and is alternately wound around the rollers of the other roller set on the shuttle and the rollers of the associated stationary roller set after passing through the nip. In one embodiment, the shuttle includes a cam follower extending therefrom which travels along a track in a rotating cam to cause the shuttle to reciprocate as the cam follower travels along the track. The profile of the track is selected so that the shuttle travels at a generally constant speed in both directions. Alternatively, a motorized stepper or servo drive programmed to follow the cam profile can be used to move the shuttle.

Preferably, the apparatus further includes a ribbon synchronization adjustment unit to shift the ribbon relative to the nip when the ribbon is generally stationary so that when the ribbon is advanced through the nip, the stripe registers with the sheet passing through the nip. In a preferred embodiment, the unit includes a ribbon synchronization adjustment mechanism comprising a frame member carrying rollers at opposed ends thereof. One of the rollers contacts the ribbon before the nip and one of the rollers contacts the ribbon after the nip. A drive moves the frame member laterally in response to a controller. The controller communicates with a first sensor detecting the position of the stripe on the ribbon and a second sensor detecting the position of the sheet relative to the nip and determines whether the ribbon needs to be shifted to register the stripe with the sheet.

According to another aspect of the present invention there is provided an apparatus for applying discrete stripes to individual documents on sheets during a document production process, each of said sheets including a plurality of rows of documents, said stripes being carried by ribbons each of which is associated with a respective row of documents, said apparatus comprising:

- a drive to advance said ribbons from unwind reels to take-up reels;
- a nip intermediate said unwind reels and said take-up reels through which said ribbons and successive sheets pass to apply said stripes to said documents; and
- a ribbon speed modulator acting on said ribbons to modulate the speed of said ribbons passing through said nip so that the speed of said ribbons passing through said nip coincides generally with the speed of the sheets passing through said nip without changing the speed at which said ribbons are advanced by said drive.

According to still yet another aspect of the present invention there is provided in a document production process where stripes disposed on a carrier are applied onto a moving web as the carrier and the web pass through a nip, the carrier being advanced by a generally constant speed drive and the web undergoing changes in speed relative to the nip, the improvement comprising:

- a modulator acting on said carrier to modulate the speed of said carrier passing through said nip so that the speed of said carrier passing through said nip coincides generally with the speed of the web passing through said nip without changing the speed at which said carrier is advanced by said drive.

In still yet another aspect of the present invention there is provided a method of applying a stripe disposed on a carrier onto a moving web comprising the steps:

- advancing said carrier via a drive through a nip through which said web passes to apply said stripe to said web; and
- modulating the speed of said carrier passing through said nip so that the speed of said carrier passing through said nip coincides generally with the speed of the web passing through said nip without changing the speed at which said carrier is advanced by said drive.

The present invention provides advantages in that the ribbon is stopped relative to the nip during a gap between successive sheets passing through the nip to avoid stripe wastage. This is achieved without disrupting the drive advancing the ribbon.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENTS

Figure 1:
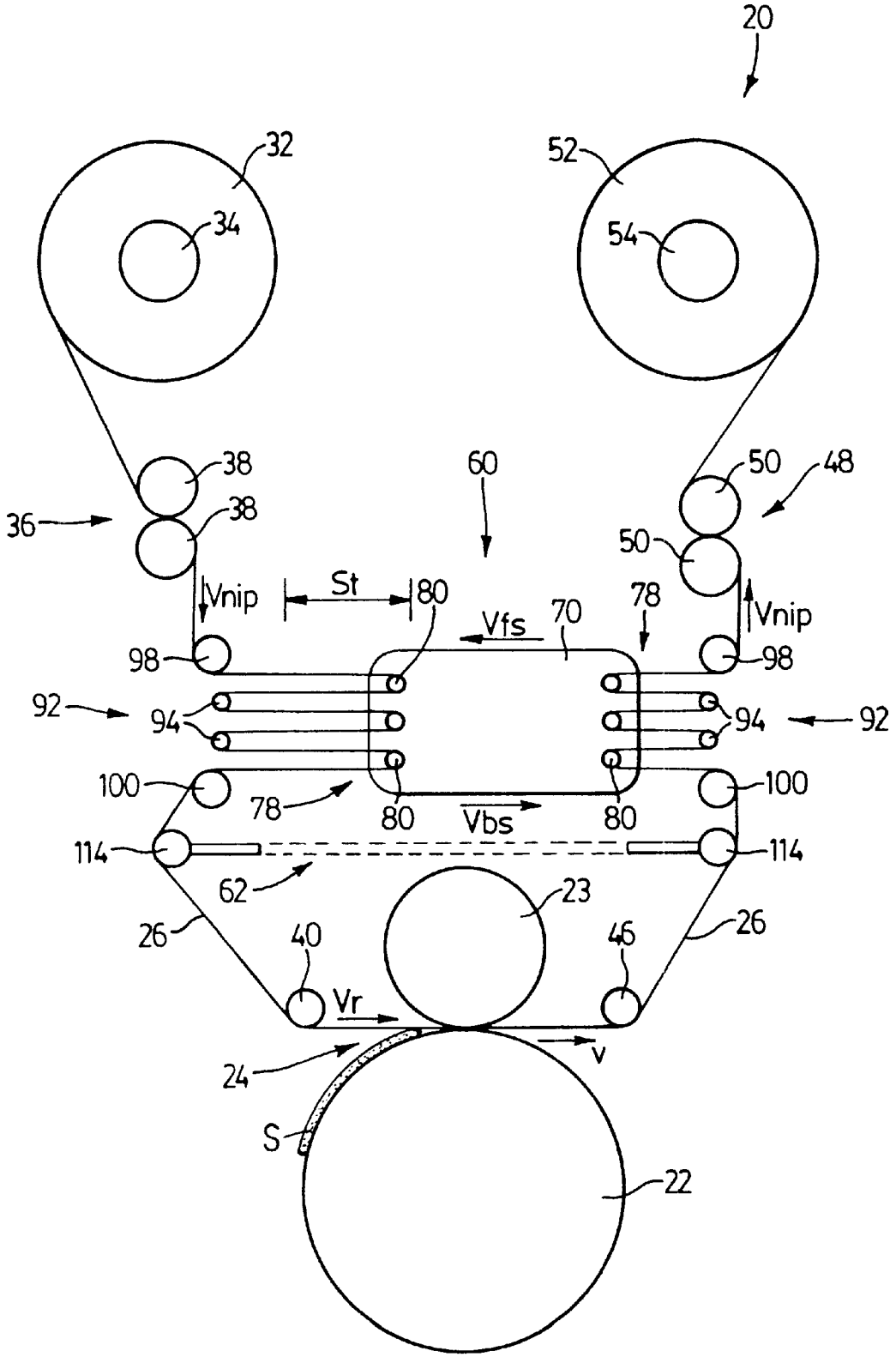
FIG. 1 is a side elevational view of an apparatus for applying a stripe to a moving web in accordance with the present invention.
Figure 2:
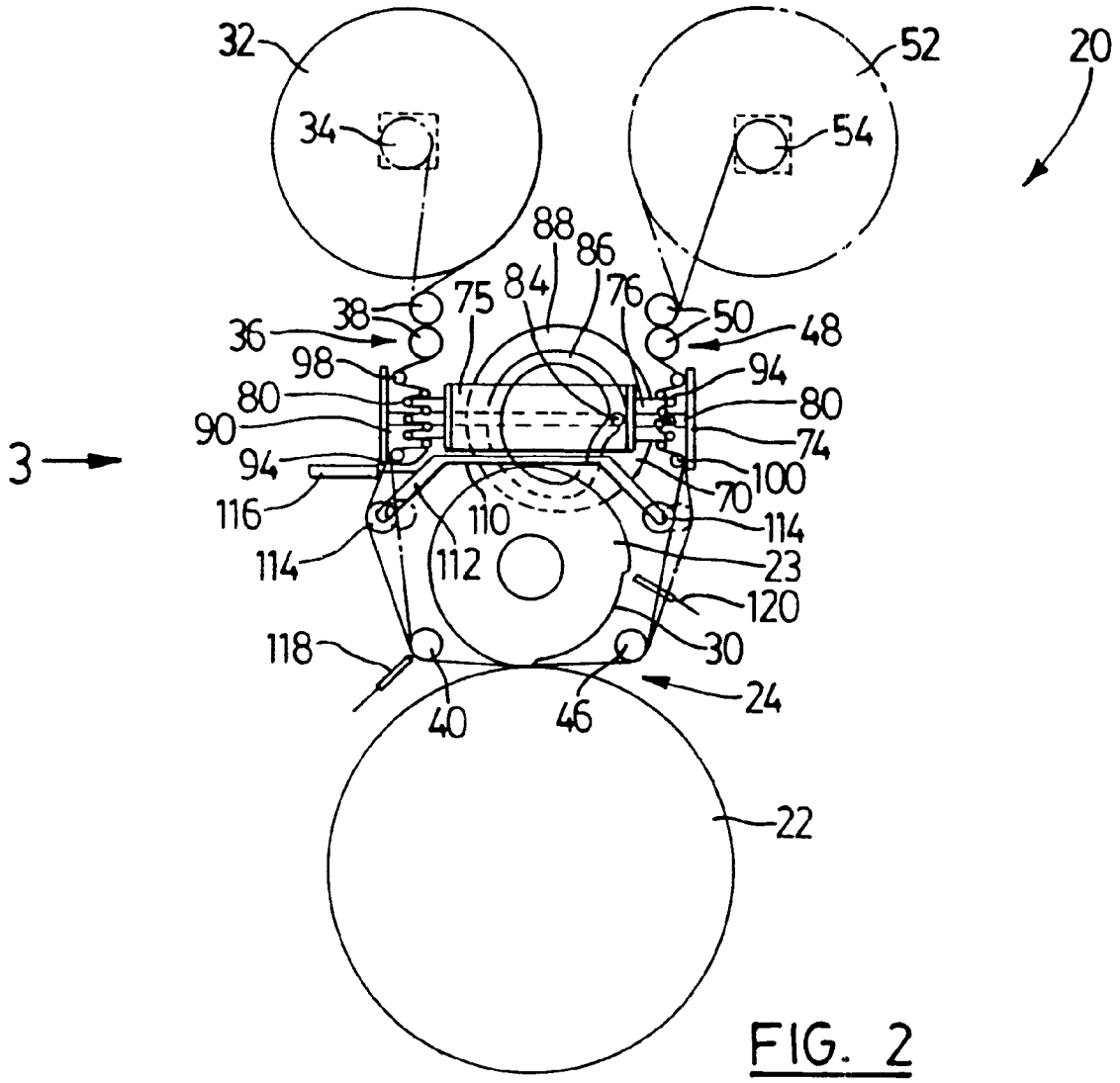
FIG. 2 is another side elevational view of the apparatus of FIG. 1 showing further detail.
Figure 3:
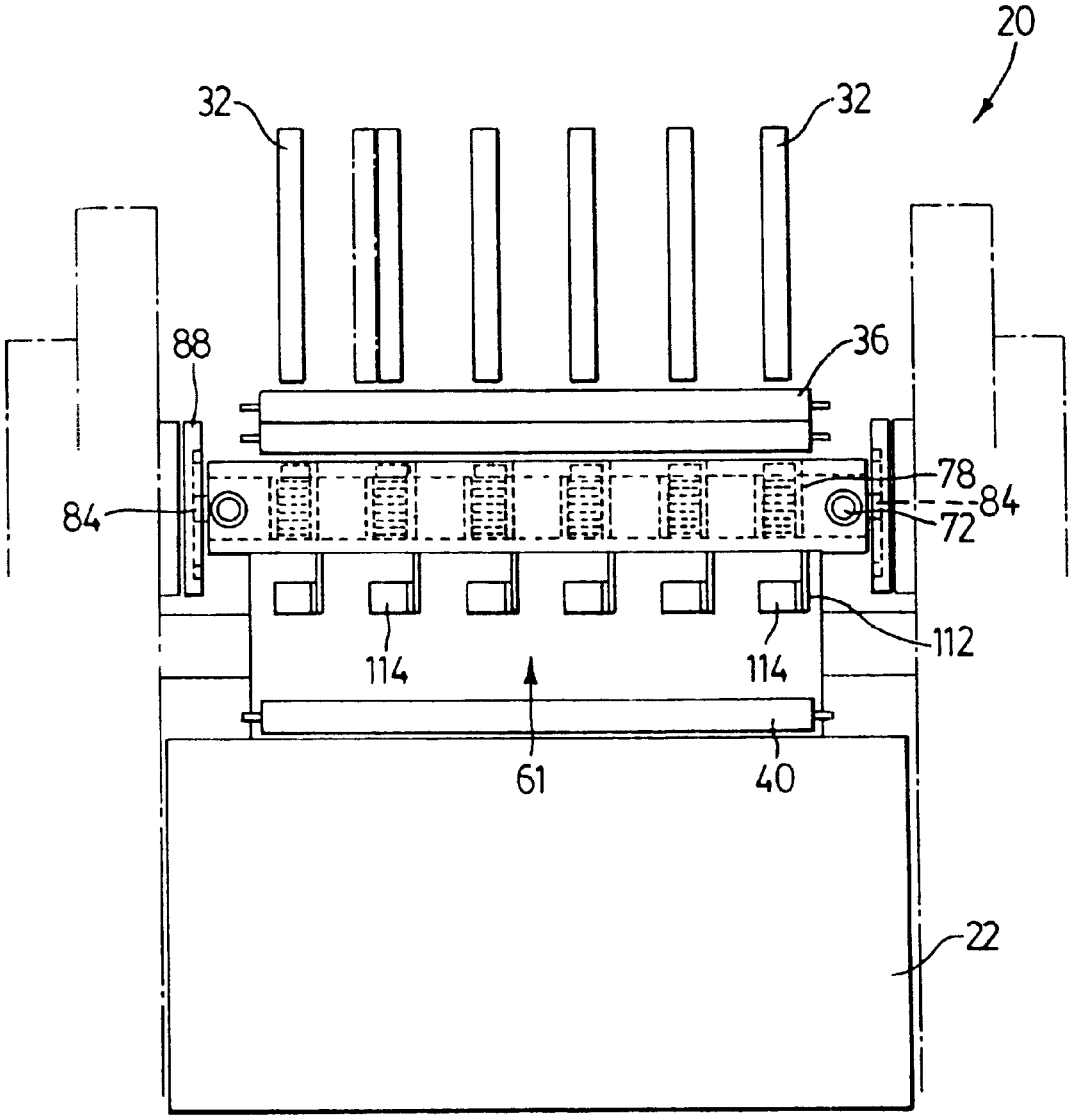
FIG. 3 is a front view of the apparatus of FIG. 2 taken in the direction of arrow 3.

Referring now to FIGS. 1 to 3, an apparatus for applying a stripe disposed on a carrier onto a moving web is shown and is generally indicated to by reference numeral 20. The apparatus 20 is particularly suited to the application of discrete stripes in the form of foil-based security structures disposed on reels of ribbons onto individual banknotes of banknote sheets.

During the production of banknotes, sheets of banknotes are transported by a series of fixed diameter cylinders and therefore, gaps occur between successive banknote sheets. During this process, the banknote sheets are delivered to the apparatus 20 so that security structures can be applied to the individual banknotes, one of which is shown in FIG. 1 and identified by reference character S, of the banknote sheets. The apparatus 20 includes an impression cylinder 22 and an application cylinder 23 disposed above the impression cylinder 22 and forming a nip 24 therebetween. The impression cylinder 22, as it rotates, picks up a banknote sheet and delivers the banknote sheet S to the nip 24. Ribbons 26 carrying security structures are also fed through the nip 24. Each ribbon 26 is registered with a row of banknotes on the banknote sheet passing through the nip 24. In this manner, the security structures on the ribbons can be transferred to the banknotes on the banknote sheets by the application cylinder 23. The application cylinder 23 has a depression 30 formed in its outer surface (see FIG. 2), which during rotation of the application cylinder, arrives at the nip 24 coincident with gaps between successive banknote sheets delivered to the nip. In this manner, security structures on the ribbons 26 are not pressed onto the impression cylinder 22 when there is a gap between banknote sheets.

The ribbons 26 are drawn from spaced reels 32 mounted and keyed on an unwind roller 34 by a slave nip drive 36 including a pair of nip rollers 38. From the slave nip drive 36, the ribbons are delivered to the nip 24 by way of a common feed roller 40. After exiting the nip 24, the ribbons 26 pass around another common feed roller 46 and are fed to a master nip drive 48 including a pair of nip rollers 50. The master nip drive 48 delivers the ribbons 26 to take-up reels 52 disposed on a take-up roller 54. The master and slave nip drives 48 and 36 respectively are driven so that the ribbons 26 are unwound from the reels 32 and taken up by the reels 54 at a generally constant speed. Through electronic gearing (not shown), the master nip drive 48 is driven at a slightly faster speed than the slave nip drive 36 to place tension on the ribbons 26. The ribbon tension is maintained at the unwind roller 34 by a brake slip clutch (not shown) and at the take-up roller 54 by a drive slip clutch (not shown).

Disposed along the travel path of the ribbons 26 is a ribbon speed modulator 60 and a ribbon synchronization (sync) adjustment unit 61 positioned below the ribbon speed modulator 60. The ribbon speed modulator 60 serves to modulate the speed of the ribbons 26 traveling between the master and slave nip drives 48 and 36 respectively so that the sections of the ribbons passing through the nip 24 are stopped when a gap between successive banknote sheets occurs at the nip 24. This of course is achieved without altering the speed of the master and slave nip drives 48 and 36. In this manner, sections of the ribbons carrying security structures are not wasted.

The ribbon sync adjustment unit 61 includes a plurality of ribbon sync adjustment mechanisms 62. Each mechanism 62 is associated with a respective ribbon 26 and serves to register the ribbon with a row of banknotes on each banknote sheet as each banknote sheet is delivered to the nip 24 so that the security structures are transferred to the banknotes of each banknote sheet at the desired locations.

The ribbon speed modulator 60 includes a reciprocating or oscillating ribbon advance/retard shuttle 70 mounted on a pair of linear bearings 72 extending between supports 74. The shuttle 70 includes a rectangular main frame 75 having roller set supports 76 at its opposite ends. A plurality of horizontally spaced roller sets 78 is mounted on each of the supports 76. Each roller set 78 includes a plurality of vertically spaced rollers 80, in this example three, and is associated with one of the ribbons 26. Cam followers 84 extend from opposite sides of the main frame 74 and are accommodated by tracks 86 formed in cams 88. The cams 88 are rotated by a drive mechanism (not shown).

A mounting bracket 90 is secured to each support 74 and is in line with the shuttle 70. Horizontally spaced roller sets 92 are mounted on each bracket 90. Each roller set 92 includes a plurality of vertically spaced rollers 94, in this example four, and is associated with a respective one of the roller sets 78. The rollers 94 and 80 of each roller set 92 and its associated roller set 78, are staggered vertically. Each mounting bracket 90 also supports top and bottom feed rollers 98 and 100 for each of the ribbons 26.

On the ribbon unwind side of the apparatus 20, the top feed rollers 98 receive the ribbons 26 from the slave nip drive 36 and deliver the ribbons to the top roller 94 of each roller set 92. From the rollers 94, the ribbons 26 alternately wind around the rollers 80 and the rollers 94 before passing around the bottom feed rollers 100. On the ribbon take-up side of the apparatus 20, the bottom feed rollers 100 receive the ribbons 26 from the common feed roller 46 and deliver the ribbons to the bottom roller 94 of each roller set 92. From the rollers 94, the ribbons 26 alternately wind around the rollers 80 and the rollers 94 before passing around the top feed rollers 98.

Each ribbon sync adjustment mechanism 62 includes a frame member 110 having a pair of outwardly and downwardly extending arms 112. Rollers 114 are mounted on the ends of the arms 112 and contact the associated ribbon 26 on either side of the nip 24. Each frame member 110 is mounted on a linear bearing or guideway (not shown). A stepper or servo drive 116 is coupled to each frame member 110 by way of a threaded rod (not shown) and is actuable to rotate the rod thereby to move the frame member laterally along the linear bearing. A sync mark sensor 118 is positioned adjacent the common feed roller 40 and detects sync marks on its associated ribbon 26. The sync marks represent stripe positions on the ribbon. A timing sensor 120 is positioned near the application cylinder 23 and detects the depression 30 in its outer surface to allow the banknote sheet position with respect to the nip 24 to be determined. A controller (not shown) receives the output of the sync mark sensors 118 and the output of the timing sensor 120 and provides output to the drives 116. The drives 116 are responsive to the controller and move the frame members 110 laterally to move the ribbons 26 and thereby adjust registration of the ribbons with respect to the banknote sheet passing through the nip 24 by shifting the ribbons relative to the nip 24.

During operation and assuming the ribbons 26 have been threaded through the apparatus 20, the master and slave nip drives 48 and 36 respectively are actuated to unwind the ribbons 26 from the unwind reels 32 and to take up the ribbons on the take-up reels 52 at a generally constant speed while maintaining tension on the ribbons. As this occurs, the drive mechanism is operated to rotate the cams 88. As the cams 88 rotate, the cam followers 84 travel along the tracks 86 causing the shuttle 70 to reciprocate along the linear bearings 72. The profile of the tracks 86 is selected so that the shuttle 70 moves at a constant velocity in both directions. Movement of the shuttle 70 is timed and its speed in each direction controlled so that the shuttle moves towards the ribbon unwind side of the apparatus 20 when banknote sheets are passing through the nip 24 and moves towards the ribbon take-up side of the apparatus 20 when a gap between banknote sheets occurs at the nip. In this way, the ribbons 26 are delivered through the nip 24 at the same velocity as the banknote sheets when banknote sheets are passing through the nip and are stopped when gaps between successive banknote sheets occur at the nip 24.

Specifically, when a gap between banknote sheets occurs at the nip 24, the depression 30 in the outer surface of the application cylinder 23 arrives at the nip so that the ribbons 26 are not pressed onto the impression cylinder 22. At the same time, the shuttle 70 is moved towards the ribbon take-up side of the apparatus 20. At the ribbon take-up side of the apparatus 20, movement of the shuttle 70 in this direction, reduces the length of the run that each ribbon 26 encounters as it winds around the rollers 94 and 80 resulting in slack being developed in the ribbons 26. The master nip drive 48, which operates at a generally constant speed, takes up the slack in the ribbons. As a result, the master nip drive 48 does not pull the ribbons 26 through the nip 24.

On the ribbon unwind side of the apparatus 20, movement of the shuttle 70 in this direction increases the length of the run that each ribbon 26 encounters as it winds around the rollers 94 and 80 thereby to take up the slack in the ribbons advanced by the slave nip drive 36. Since the master nip drive 48 takes up the slack developed in the ribbons on the ribbon take-up side of the apparatus 20 and since the shuttle 70 takes up the slack developed in the ribbons 26 on the ribbon unwind side of the apparatus 20, the ribbons 26 are not pulled through the nip 24. As a result, the ribbons 26 are stationary at the nip 24 when a gap between successive banknote sheets occurs.

When the ribbons 26 are stationary, the sync mark sensors 118 detect the positions of the sync marks and hence the stripes on the ribbons 26. The output of the sync mark sensors 118 and the output of the timing sensor 120 are conveyed to the controller which determines whether the stripes on the ribbons are properly positioned so that when a banknote sheet arrives at the nip 24 and the ribbons 26 are advanced, the stripes will be transferred to the banknotes at the desired locations. If one or more of the ribbons 26 are not properly positioned, the controller signals the drives 116 which in turn move the frame members 110 in the appropriate directions to shift the ribbons relative to the nip 24 to register the ribbons with the banknote sheet.

When a banknote sheet arrives at the nip 24, the outer surface of the application cylinder 23 presses the ribbons 26 onto the banknote sheet. At the same time, the shuttle 70 is moved towards the ribbon unwind side of the apparatus 20. At the ribbon unwind side of the apparatus 20, movement of the shuttle 70 in this direction reduces the length of the run that each ribbon 26 encounters as it winds around the rollers 94 and 80 and correspondingly increases the length of the run that each ribbon encounters as it winds around the rollers 94 and 80 at the ribbon take-up side of the apparatus 20. The slack developed in ribbons 26 at the ribbon unwind side of the apparatus is taken up by the shuttle 70 on the ribbon take-up side of the apparatus 20 causing the ribbons 26 to be pulled through the nip 24 at the same velocity as the banknote sheet. As the ribbons 26 and banknote sheet pass through the nip 24, the application cylinder 23 applies the stripes to the banknotes.

When a ribbon 26 is traveling at the speed of the banknote sheet, its velocity can be expressed as:

$$V_r = V_{nip} + 2NV_{fs} \tag{1}$$

where:

$V_{nip}$ is the ribbon 26 speed at the nip 24;

N is the number of rollers 84 on the shuttle 70; and $V_{fs}$ is the speed of the shuttle 70 moving in a forward direction towards the ribbon unwind side of the apparatus 20.

When a gap between banknote sheets occurs at the nip 24, the velocity of the ribbon 26 is zero and the following expression holds:

$$V_r = V_{nip} - 2NV_{bs} = 0 \tag{2}$$

where:

$V_{bs}$ is the speed of the shuttle 70 moving in a backward direction towards the ribbon take-up side of the apparatus 20.

If the distance $S_t$ traveled by the shuttle 70 in both directions is equal then:

$$S_t = V_{fs} * t_f = V_{bs} * t_b \tag{3}$$

where:

$t_f$ is the time taken for the shuttle 70 to complete travel in the forward direction; and $t_b$ is the time taken for the shuttle 70 to complete travel in the backward direction.

Solving the above equations yields the following relationships:

$V_{fs}$=v((pie)*d−2L)/120Nn;

$V_{bs}$=vL/60Nn;

$V_{nip}$=vL/30n; and $S_t$=500L(1−2L/(pie)*d)/N;

where:

v is the velocity of the banknote sheets;

d is the diameter of the impression cylinder 22;

L is the banknote sheet length in meters; and n is the number of sheets held by the impression cylinder 22.

As will be appreciated from the above equations, the shuttle speed and distance to travel are inversely proportional to the number of shuttle loops N. Thus, as the number of shuttle loops N increases, the shuttle speed and travel distance are reduced by a factor of 1/N.

For example, for an impression cylinder 22 having a diameter equal to 0.6 m and having a sheet carrying capacity equal to 2, a shuttle 70 having three rollers 84 in each roller set and assuming banknote sheets having a length equal to 700 mm and running at a speed equal to 10,000 banknote sheets per hour, using the above relationships:

$V_{fs}$=6.74 m/min;

$V_{bs}$=19.44 m/min;

$V_{nip}$=116.67 m/min; and $S_t$=30.02 mm

Using equation 1, the ribbon speed when the shuttle 70 is moving in a forward direction is equal to:

$$116.67+(6.74*2*3)=157.08 \text{ m/min}$$

This of course matches the speed of the banknote sheet.

Using equation 2, the ribbon speed when the shuttle 70 is moving in a backward direction is equal to:

$$116.67-(19.44*2*3)=0.0 \text{ m/min}$$

Figure 4A:
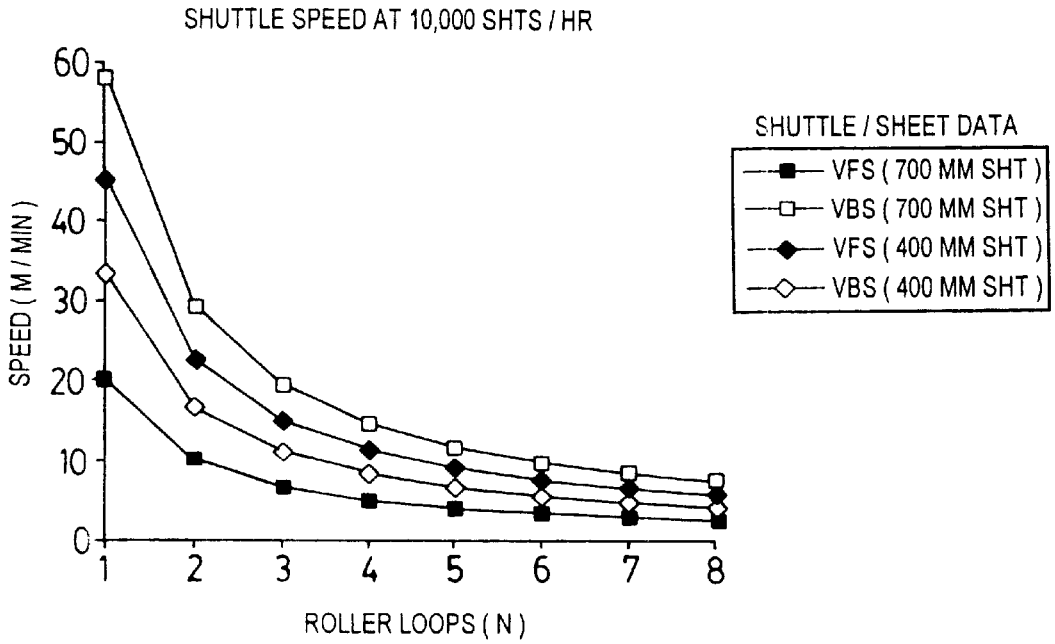
FIGS. 4A and 4B are graphs showing shuttle speed as a function of shuttle rollers, banknote sheet size and banknote sheet speed.
Figure 4B:
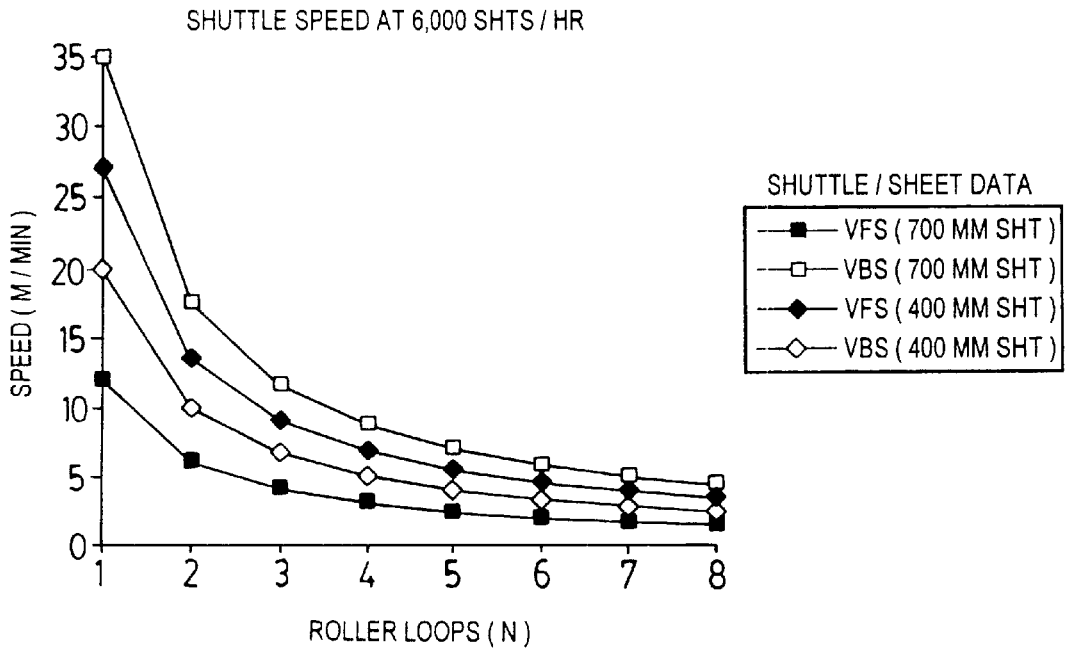
Figure 5:
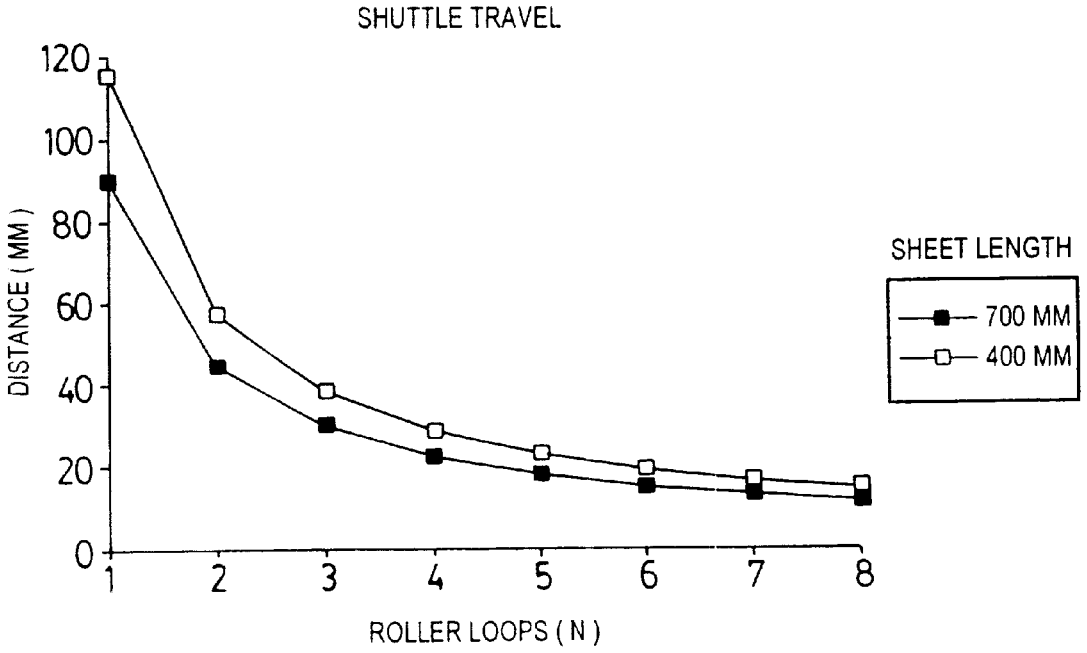
FIG. 5 is a graph showing shuttle travel distance as a function of shuttle roller and banknote sheet size.

FIG. 4 shows shuttle speeds calculated as a function of the number of rollers 80 in each roller set 78, the banknote sheet size and the banknote sheet speed. FIG. 5 shows the shuttle travel distance calculated as a function of the number of rollers 80 in each roller set 78 and the banknote sheet size. As will be appreciated, by increasing the number of rollers 80 in each roller set 78 and reducing the banknote sheet speed, a slow shuttle speed and a small shuttle travel distance can be achieved. This allows acceleration forces placed on the ribbon speed modulator 60 to be reduced. As a result, the dynamics of the present apparatus become more favourable as mechanical loads decrease.

The present invention allows a stripe on a carrier to be applied to a moving web without disrupting the carrier drive while avoiding stripe waste. Although the apparatus 20 has been described for use in the application of discrete stripes in the form of security structures onto individual banknotes of banknote sheets, those of skill in the art will appreciate that the apparatus can be used to apply stripes to virtually any moving web which undergoes changes in its velocity relative to the nip. The stripes may be disposed on the carrier at discrete locations or continuous along its length.

Although the shuttle has been described as being driven by rotating cams, those of skill in the art will appreciate that alternative drives can be used such as a motorized stepper or servo drive programmed to follow the cam profile. As will also be appreciated by those of skill in the art, variations and modifications may be made to the present invention without departing from the scope thereof as defined by the appended claims.

We claim:

1. An apparatus for applying stripes disposed on a ribbon at spaced locations to discontinuous sheets, said apparatus comprising:

a first drive to advance the ribbon continuously from an unwind reel to a take-up reel at a generally constant speed;

a nip intermediate said unwind reel and said take-up reel through which said ribbon and successive sheets pass, said nip applying said stripes to each sheet as said each sheet passes through said nip;

a reciprocating shuttle moveable back and forth along a generally linear path, said shuttle including a first set of spaced rollers thereon adjacent one end thereof and a second set of spaced rollers thereon adjacent an opposite end thereof;

a first stationary set of spaced rollers associated with said first set of rollers, said first stationary set of spaced rollers being positioned adjacent one end of said path and intermediate said unwind reel and nip;

a second stationary set of spaced rollers associated with said second set of rollers, said second stationary set of spaced rollers being positioned adjacent an opposite end of said path and intermediate said nip and take-up reel, said ribbon alternately winding around the rollers of said first set of spaced rollers and said first stationary set of spaced rollers as said ribbon travels from said unwind reel to said nip and alternately winding around the rollers of said second set of spaced rollers and said second stationary set of spaced rollers as said ribbon travels from said nip to said take-up reel;

a second drive to reciprocate said shuttle along said linear path, said shuttle being driven in a manner so that said ribbon intermittently moves through said nip even though said ribbon is advanced continuously by said first drive with said ribbon being stationary at said nip when a gap between successive sheets occurs at said nip; and a fine ribbon adjustment mechanism decoupled from said shuttle and said nip, said fine ribbon adjustment mechanism acting on said ribbon to position precisely said ribbon relative to each successive sheet being delivered to said nip when said ribbon is stationary at said nip.

2. An apparatus according to claim 1 wherein each of said first set and second set of spaced rollers and each of said first stationary set and second stationary set of spaced rollers includes at least three rollers.

3. An apparatus according to claim 2 wherein the rollers of said first set and the rollers of said first stationary set are staggered and wherein the rollers of said second set and the rollers of said second stationary set are staggered.

4. An apparatus according to claim 1 wherein said second drive includes at least one rotating cam having a track thereon and wherein said shuttle further includes a cam follower extending therefrom, said cam follower traveling along said track during rotation of said cam thereby to cause said shuttle to reciprocate, the profile of said track being selected so that said shuttle travels at a generally constant speed as said shuttle moves back and forth along said linear path.

5. An apparatus according to claim 1 wherein said nip is defined by an impression cylinder carrying said sheets and an application cylinder, said application cylinder having a depression formed in an outer surface thereof, rotation of said application cylinder being timed such that said depression passes through said nip coincident with gaps between successive sheets.

6. An apparatus according to claim 5 wherein said fine ribbon adjustment mechanism includes:

a frame member carrying rollers at opposed ends thereof, one of said rollers contacting said ribbon before said nip and one of said rollers contacting said ribbon after said nip;

a third drive to move said frame member laterally;

a first sensor to detect the position of the stripes on said ribbon;

a second sensor to detect the position of said depression in said application cylinder relative to said nip; and a controller in communication with said first and second sensors to determine if said ribbon in not registered with the sheet being delivered to the nip, said third drive being responsive to said controller to move said frame member to bring one of said rollers into contact with said ribbon and shift said ribbon relative to said nip thereby to register said stripes with the sheet passing through said nip.

7. An apparatus according to claim 1 wherein said first drive includes a master nip drive adjacent said take-up reel and a slave nip drive adjacent said unwind reel.

8. An apparatus according to claim 7 wherein said master nip drive is driven at a slightly faster speed than said slave nip drive to place tension on said ribbon and wherein tension on said ribbon is maintained by a brake slip clutch at said unwind reel and a drive slip clutch at said take-up reel.

9. An apparatus for applying discrete stripes to individual documents on discontinuous sheets during a document production process, each of said sheets including a plurality of rows of documents, said stripes being carried by ribbons, each ribbon being associated with a respective row of documents, said apparatus comprising:

a first drive to advance the ribbons continuously from unwind reels to take-up reels at a generally constant speed;

a nip intermediate said unwind reels and said take-up reels through which said ribbons and successive sheets pass, said nip applying said stripes to said documents;

a reciprocating shuttle moveable back and forth along a generally linear path, said shuttle including for each ribbon, a first set of spaced rollers thereon adjacent one end thereof and a second set of spaced rollers thereon adjacent an opposite end thereof;

a first stationary set of spaced rollers associated with each of said first set of spaced rollers, each said first stationary set of spaced rollers being positioned adjacent one end of said path and intermediate said unwind reels and nip;

a second stationary set of spaced rollers associated with each of said second set of spaced rollers, each said second stationary set of spaced rollers being positioned adjacent an opposite end of said path and intermediate said nip and take-up reels, each ribbon alternately winding around the rollers of said first set of spaced rollers and said first stationary set of spaced rollers as said ribbon travels from said unwind reel to said nip and alternately winding around the rollers of said second set of spaced rollers and said second stationary set of spaced rollers as said ribbon travels from said nip to said take-up reel;

a second drive to reciprocate said shuttle along said linear path, said shuttle being driven in a manner so that said ribbons are stationary at said nip when gaps between successive sheets occur at said nip even though said ribbons are advanced continuously by said first drive; and a fine ribbon adjustment unit decoupled from said shuttle and said nip, said fine ribbon adjustment unit acting on each ribbon to position precisely each ribbon relative to each successive sheet being delivered to said nip when said ribbons are stationary at said nip.

10. An apparatus according to claim 9 wherein each first set and second set of spaced rollers and each first stationary set and second stationary set of spaced rollers includes at least three rollers and wherein the rollers of each first set and the rollers of each first stationary set are staggered and wherein the rollers of each second set and the rollers of each second stationary set are staggered.

11. An apparatus according to claim 10 wherein said second drive includes a pair of rotating cams having tracks thereon and wherein said shuttle further includes a pair of cam followers extending therefrom, said cam followers traveling along said tracks during rotation of said cams thereby to cause said shuttle to reciprocate, the profiles of said tracks being selected so that said shuttle travels at a generally constant speed as said shuttle moves back and forth along said linear path.

12. An apparatus according to claim 9 wherein said fine ribbon adjustment unit includes a mechanism for each ribbon, each mechanism including:

a frame member carrying rollers at opposed ends thereof, one of said rollers contacting said each ribbon before said nip and one of said rollers contacting said each ribbon after said nip;

a third drive to move said frame member laterally;

a sensor arrangement to detect the position of the stripes on said each ribbon and to determine the position of said sheet relative to said nip; and a controller responsive to said sensor arrangement, said controller actuating said third drive in response to sensor arrangement input to cause said third drive to move said frame member to shift said each ribbon thereby to register said stripes with said documents.

13. An apparatus according to claim 9 wherein said first drive includes a master nip drive adjacent said take-up reels and a slave nip drive adjacent said unwind reels, said master nip drive being driven at a slightly faster speed than said slave nip drive to place tension on said ribbons, tension being maintained on said ribbons by a brake slip clutch at said unwind reels and a drive slip clutch at said take-up reels.

14. An apparatus for applying stripes on a ribbon to a discontinuous web, comprising:

a first drive to advance said ribbon continuously from an unwind reel to a take-up reel at a generally constant speed;

a driven nip intermediate said unwind reel and said take-up reel through which said ribbon and said web pass, said nip applying stripes to said web;

a coarse ribbon adjustment mechanism including a reciprocating shuttle, said ribbon being wound around a first set of rollers on said shuttle as said ribbon travels from said unwind reel to said nip and being wound around a second set of rollers on said shuttle as said ribbon travels from said nip to said take-up reel;

a second drive to reciprocate said shuttle, said shuttle being driven to modulate the speed of said ribbon so that said ribbon is stationary at said nip during gaps in said web at said nip even though said ribbon is advanced continuously by said first drive; and a fine ribbon adjustment mechanism decoupled from said coarse ribbon adjustment mechanism and said nip, said fine ribbon adjustment mechanism acting on said ribbon to position precisely said ribbon relative to said web.

15. An apparatus according to claim 14 wherein said fine ribbon adjustment mechanism acts on said ribbon when said ribbon is stationary.

16. An apparatus according to claim 15 wherein said fine ribbon adjustment mechanism includes:

a frame member carrying rollers at opposed ends thereof, one of said rollers contacting said ribbon before said nip and one of said rollers contacting said ribbon after said nip;

a third drive to move said frame member laterally;

a sensor arrangement to detect the position of the stripes on said ribbon and to determine the position of said sheet relative to said nip; and a controller responsive to said sensor arrangement, said controller actuating said third drive in response to sensor arrangement input to cause said third drive to move said frame member to shift said ribbon thereby to register said stripes with said web.

* * * * *